United States Patent [19]

Saleh

[11] Patent Number: 4,598,767

[45] Date of Patent: Jul. 8, 1986

[54] MULTIPLE PRESSURE CONDENSER FOR STEAM TURBINES, WITH HEATING DEVICES FOR SUPPRESSING CONDENSATE OVERCOOLING

[76] Inventor: Abdel Saleh, Rheinstrasse 30, D-7891 Hohentengen, Fed. Rep. of Germany

[21] Appl. No.: 613,021

[22] Filed: May 22, 1984

[30] Foreign Application Priority Data

Jun. 9, 1983 [CH] Switzerland ..... 3163/83

[51] Int. Cl.[4] ..... F28B 9/08; F28B 9/10

[52] U.S. Cl. ..... 165/113; 60/692; 60/693; 165/114

[58] Field of Search ..... 60/692, 693, 690; 165/113, 114

[56] References Cited

U.S. PATENT DOCUMENTS 3,698,476 10/1972 Wyzalek et al. ..... 165/113 X
3,817,323 6/1974 Ebara et al. ..... 165/110
4,353,217 10/1982 Nishioka et al. ..... 60/693 X

FOREIGN PATENT DOCUMENTS 2737539 3/1979 Fed. Rep. of Germany ..... 60/693

*Primary Examiner*—Sheldon J. Richter
*Attorney, Agent, or Firm*—Burns, Doane, Swecker & Mathis

[57] ABSTRACT

A multiple pressure condenser has heating devices for the overcooled parts of the condensate, which devices are accommodated alone or preferably in pairs in one or more of the condenser parts. The heating devices have perforated droplet plates located one above the other, from which droplet plates the overcooled condensate drips downwards in steps and is heated to at least the saturation temperature of the condenser space by high pressure exhaust steam flowing upwards. The overcooled condensate arrives at the highest droplet plate via drain and rising ducts, which are connected to the space over the intermediate floor or floors which separate the exhaust steam spaces from the hot well.

4 Claims, 11 Drawing Figures

MULTIPLE PRESSURE CONDENSER FOR STEAM TURBINES, WITH HEATING DEVICES FOR SUPPRESSING CONDENSATE OVERCOOLING

BACKGROUND OF THE INVENTION

The present invention relates to multiple pressure condensers for steam turbines, and, more particularly to means for suppressing overcooling of the condensate.

In steam turbine condensers, the heat extracted from the exhaust steam should be just sufficient to convert it into condensate. Further cooling below the saturation temperature of the exhaust steam should be avoided because energy must again be used during the feed water preheating in order to compensate for the heat losses associated with the overcooling and this additional use of energy has, naturally, a deleterious effect on the overall efficiency of the steam turbine installation.

In order to suppress this overcooling, it is known, in multiple pressure condensers, to heat the overcooled condensate in the low pressure and intermediate pressure part by exhaust steam from the high pressure part of the condenser. However, the overcooling can only be partially decreased by this means at appropriate economic expense because not all the high pressure exhaust steam condenses since a part of it will pass into the intermediate pressure part and the low pressure part. This is due to the unavoidable leakage between the condenser parts. The desired reduction in the heat consumption or improvement to the condenser vacuum cannot, therefore, be completely achieved in this way. Furthermore, this procedure involves the danger of erosion on the loops of cooling tubes due to effervescing condensate impinging on the cooling tubes.

A further method for suppressing the condensate overcooling consists in condensate originating from the low pressure part being caused to emerge in the intermediate pressure part as droplets, from a distributor plate, into exhaust steam derived from the high pressure part. In order to obtain the desired heating of the colder condensate, a rather large dropping height is necessary for the condensate droplets, which is structurally undesirable.

The same disadvantage applies to a method in which condenstate extracted from the low pressure part and the intermediate pressure part flows onto lower level inclined plates in the high pressure part, from whence it drains over a height of approximately 1.5 m into the hot well of the high pressure part and is heated by the high pressure exhaust steam during this process.

In a further known method, overcooled consensate is conveyed by a pump from the low pressure part into the high pressure part, atomized there and heated by the high pressure exhaust steam. The fault-prone rotating parts of the pump naturally imply a sacrifice of availability and this method is not recommended for this reason. To this must be added the further disadvantage that the energy necessary for driving the pump impairs the overall efficiency of the turbine installation.

Because of the higher operating costs resulting, condensate overcooling is very heavily penalized by the orderer of the installation, for example by one million sFr/1° C. Attempts are therefore made to suppress overcooling completely.

OBJECTS AND SUMMARY OF THE INVENTION

By means of the present invention, overcooling of the condensate from the intermediate pressure and low pressure part is to be avoided by letting it fall as droplets in the exhaust steam of the high pressure part, this being achieved while avoiding the disadvantages exhibited by designs operated according to the methods quoted above. This means that the overall height of the devices required for this purpose and, therefore, also the height of the condenser casing, should be substantially less than of the designs mentioned.

Preferred embodiments of the invention are illustrated in the accompanying drawings, in which:

DETAILED DESCRIPTION

Figure 1:
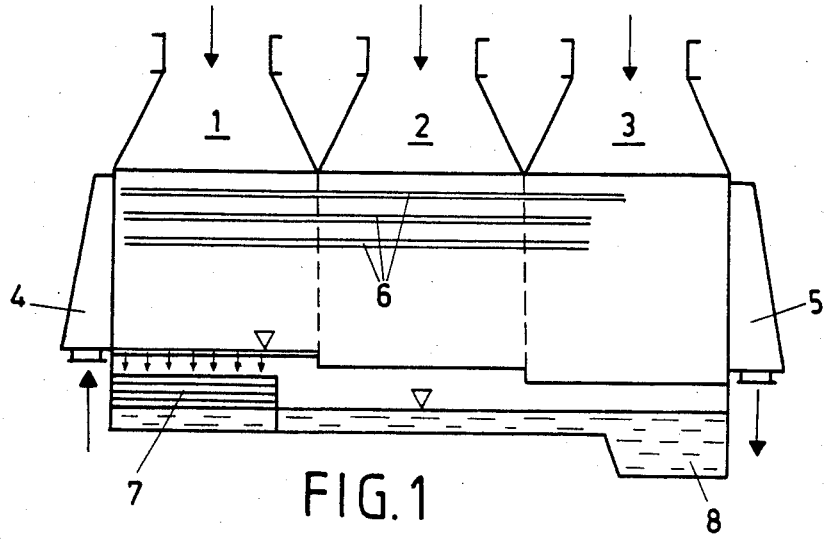
FIG. 1 is a schematic illustration of a triple pressure condenser in accordance with the invention.
Figure 2:
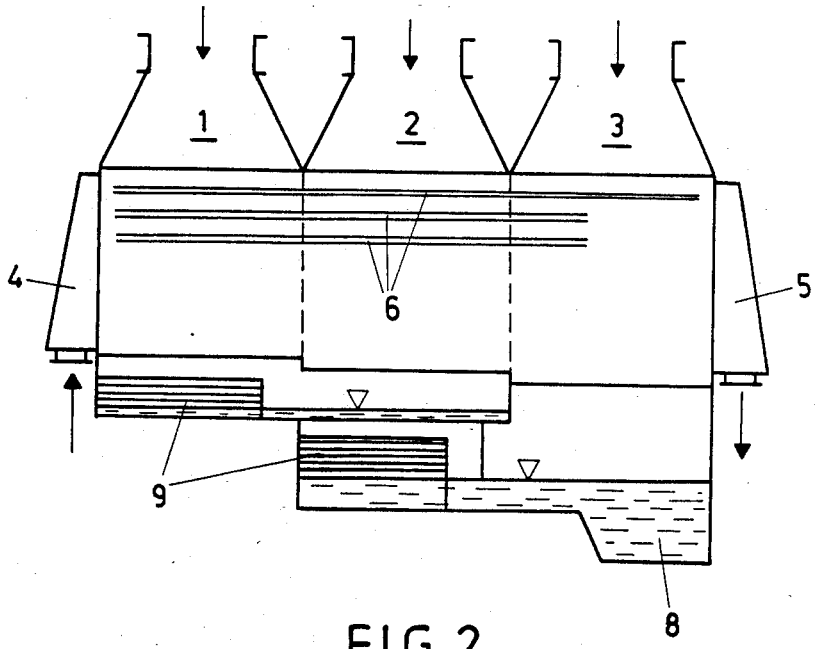
FIG. 2 PRIOR ART
FIG. 2 is a schematic illustration of a triple pressure condenser of known design.

The saving in overall height, which can be obtained by means of a condenser in accordance with the invention, FIG. 1, compared with a condenser of known design in accordance with FIG. 2, is apparent from FIGS. 1 and 2.

In both Figures, 1 indicates the low pressure part, 2 the intermediate pressure part and 3 the high pressure part of a triple pressure condenser. The arrows in the steam inlet stub pipes indicate the inflow directions of the exhaust steam from the low, intermediate and high pressure part of the turbine. Of the cooling system, the water inlet chamber 4 is shown on the left and the water outlet chamber 5 on the right, some of the loops 6 of cooling tubes being indicated within the condenser.

In the embodiment according to the invention in FIG. 1, the heating of the overcooled condensate takes place exclusively in the low pressure part 1 in a heating device 7. The bottoms of the low pressure part 1 and the intermediate pressure part 2 and part of the bottom of the high pressure part 3 are at the same level, with only the remainder of the bottom surface of the high pressure part dropping away to form the hot well 8. The overall height of such a condenser exceeds the height of the actual condenser casing, including the heating device, only by the depth of the hot well 8.

In the embodiment in FIG. 2, the heating of the overcooled condensate takes place in a known manner on the plates 9 in such a way that the overcooled condensate in the low pressure part is heated by exhaust steam from the intermediate pressure part and the condensate mixture, from the low pressure and high pressure part, collects in the intermediate pressure part so as to be further heated by the exhaust steam flowing out of the high pressure part. As mentioned initially, this method requires a rather large dropping height for the condensate to be heated in the plates 9, if it is to be satisfactorily effective, the result being an undesirable increase in the overall height of the condenser by at least this dropping height.

Figure 3:
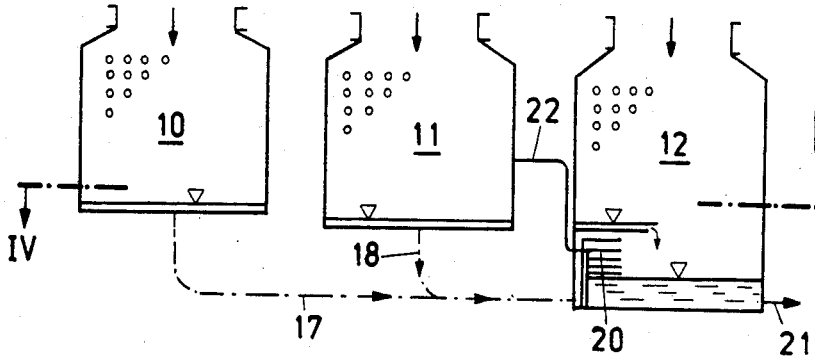
FIG. 3 is a schematic view of a separated-design triple pressure condenser, in accordance with the invention, in cross sectional representation along the line III—III in FIG. 4.
Figure 4:
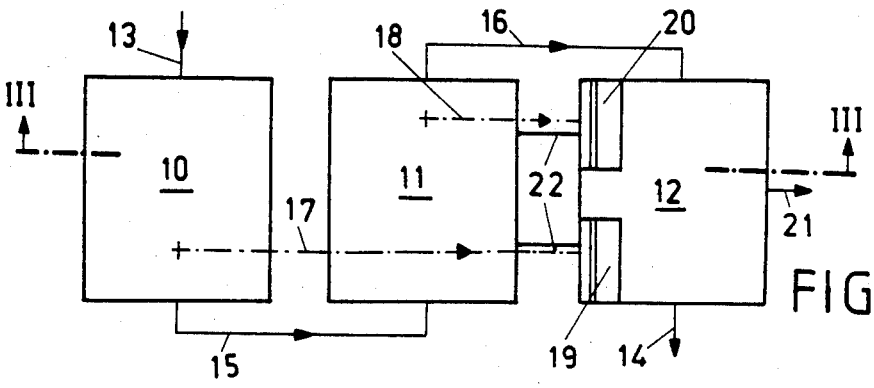
FIG. 4 is a schematic view of a separated-design triple pressure condenser in cross sectional representation along the line IV—IV in FIG. 3

FIGS. 3 and 4 show the arrangement of the heating devices in multiple pressure condensers of separated design for transverse installation. The low pressure, intermediate pressure and high pressure parts are indicated by 10, 11 and 12, respectively, the cooling water inlet stub pipe and the cooling water outlet stub pipe by 13 and 14, respectively, and the cooling water connecting pipes between the low pressure and intermediate pressure parts, on the one hand, and between the latter and the high pressure part, on the other, by 15 and 16, respectively.

Figure 11:
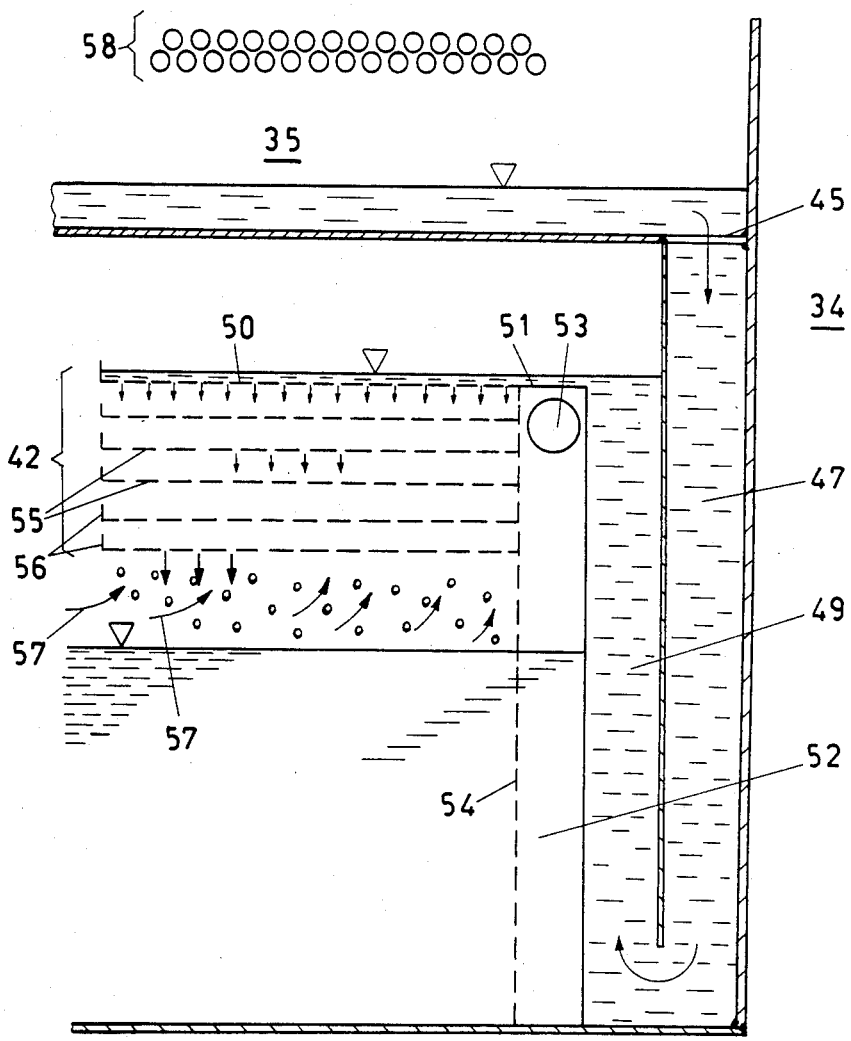
FIG. 11 shows diagrammatically represented details from the design shown in FIGS. 7, 8 and 9.

In this separated design, the overcooled condensate is withdrawn into the high pressure part 12 from the low pressure and intermediate pressure parts 10 and 11 via condensate drain-pipes 17 and 18, respectively. In the high pressure part 12, the condensate, after passing two heating devices 19 and 20, where it is heated practically to the saturation temperature, arrives in the hot well, from which it is withdrawn as boiler feed water through the condensate outlet stub pipe 21. The construction of the heating devices is explained in detail below using FIGS. 7 and 11. The level triangles in the condenser parts indicates the condensate water surface. The air extraction pipe is indicated by 22.

Figure 5:
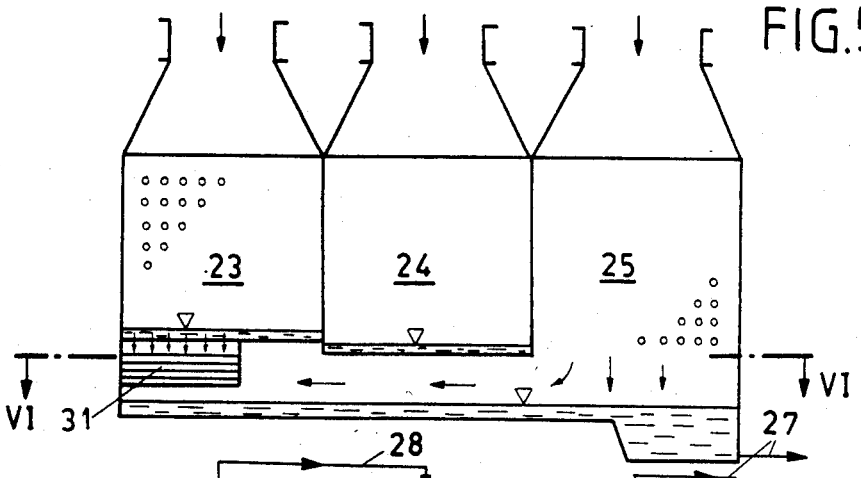
FIG. 5 is a schematic view of a triple pressure condenser, in accordance with the invention and forming one unit, for transverse installation with a common hot well taken along the lines V—V in FIG. 6.
Figure 6:
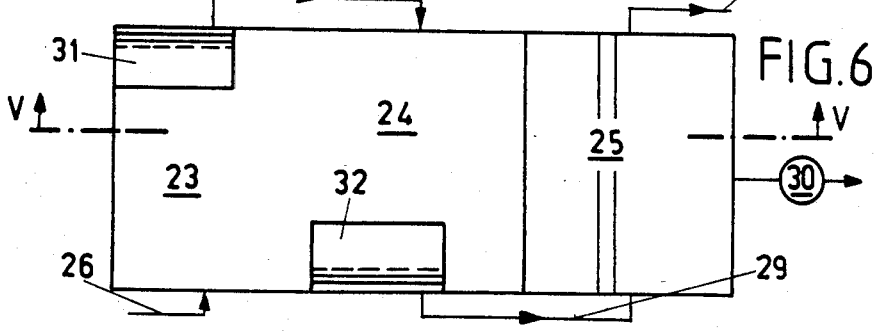
FIG. 6 is a schematic view of a triple pressure condenser, in accordance with the invention and forming one unit, for transverse installation with a common hot well taken along the lines VI—VI in FIG. 5.

The integrated triple pressure condenser shown diagrammatically in FIGS. 5 and 6 permits transverse installation, the three parts 23, 24 and 25 of this condenser thus forming one unit. The cooling water supply via the cooling water inlet stub pipe 26, the two cooling water connecting pipes 28 and 29 and the cooling water outlet stub pipe 27 is analogous to that of the separated design of FIGS. 3 and 4. The condensate pump 30 conveys the condensate into the feed water preheater.

Of the two heating devices 31 and 32, the former is located under the low pressure part 23 and the latter under the intermediate pressure part 24.

Figure 9:
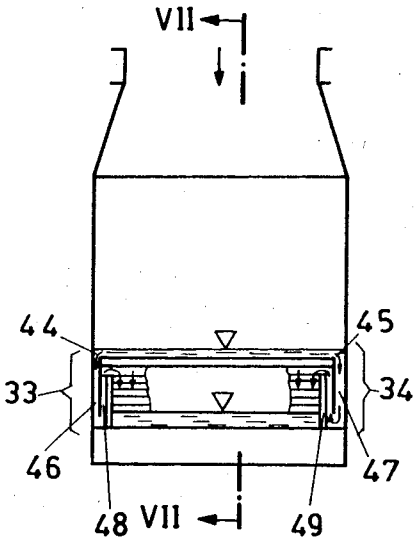
FIG. 9 is a schematic side elevation view of a triple pressure condenser as shown in FIGS. 5 and 6, for installation parallel to the axis of the turbine along the lines IX—IX of FIG. 8
Figure 7:
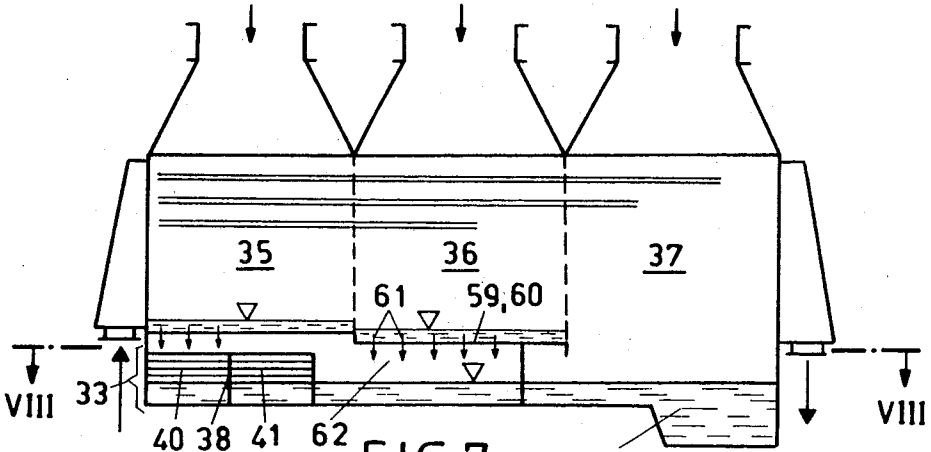
FIG. 7 shows a schematic elevation view of a triple pressure condenser, as shown in FIGS. 5 and 6, for installation parallel to the axis of the turbine along the lines VII—VII of FIG. 9.
Figure 8:
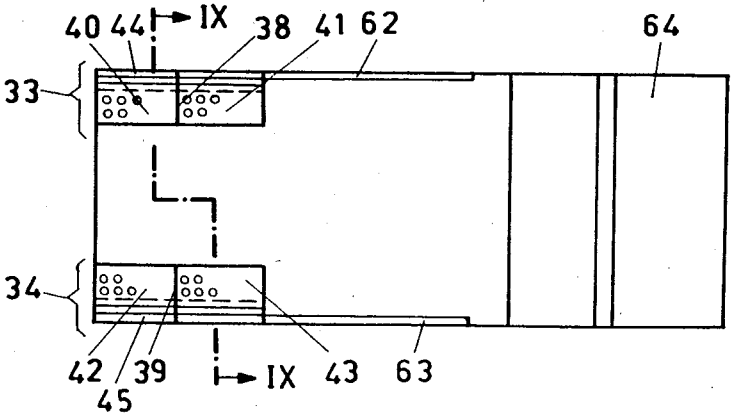
FIG. 8 is a schematic plan view of a triple pressure condenser as shown in FIGS. 5 and 6, for installation parallel to the axis of the turbine along the lines VIII—VIII of FIG. 7.

FIGS. 7, 8 and 9 diagrammatically show three side elevations of a triple pressure condenser, integrated into one unit, for longitudinal installation parallel to the axis of the turbine. The reference numbers for the elements known from the previously described embodiments are here omitted where they are unimportant to the explanation. The two heating devices 33 and 34 are accommodated under the low pressure part 35 in this case. The two heating devices 33 and 34 are each divided by bulkheads 38 and 39, located at right angles to the longitudinal axis of the condenser, into a heating chamber 40, 41 and 42, 43, respectively, for the separate heating of the low pressure and intermediate pressure condensate. The low pressure condensate is heated in the chambers 40 and 42 and the intermediate pressure condensate in the chambers 41 and 43. The low pressure condensate flows through slot-shaped condensate drain openings 44 and 45, immediately adjacent to the walls of the condensate casing, into narrow, vertical drain ducts 46 and 47, see FIG. 9, downwards to the bottom of the condenser. The low pressure condensate is then deflected upwards in similarly narrow, rising ducts 48 and 49 leading vertically upwards, again visible in FIG. 9, and overflows at the upper end of these rising ducts onto the uppermost of a series of perforated droplet plates located one above the other with a distance between the plates. The previously mentioned elements of the heating device, in fact those shown in FIG. 9 on the right-hand side and indicated by 34, are shown diagrammatically in FIG. 11 to a larger scale. The uppermost droplet plate, indicated by 50, is unperforated at its right-hand end 51 and, in this area, covers an air collection duct 52 which collects air extracted by an air extraction pipe 53. The left-hand boundary of the air collection duct 52, which shields it from the droplets of low pressure condensate in the heating chamber 42, is formed by a vertical perforated plate 54, through which air and non-condensed steam arrives in the air collection duct 52, the condensate droplets, however, being held back.

The droplet plate 50, and also all the droplet plates 55 located beneath it, have, at their free end, a rim 56 which prevents the undesirable draining of the condensate over the free edges of the droplet plates, so that it must drip downwards through the holes of the plates and be heated by the upward flow of the high pressure exhaust steam, indicated symbolically by the arrows 57, to the saturation temperature. A few tubes of the condenser tube bundle 58 are shown above the heating device.

The bulkheads 38 and 39 visible in FIG. 8 separate the heating chambers 40 and 42 for the low pressure condensate from the two heating chambers 41 and 43 for the intermediate pressure condensate. This flows from the intermediate pressure part 36 through condensate drain openings 59 and 60. The length of the drain openings corresponds to the region over which the arrows 61 extend, see FIG. 7. The intermediate pressure condensate flows downwards into drain ducts 62 and 63 having the same cross-section as the drain ducts 46 and 47 for the low pressure and intermediate pressure condensate respectively. Since the section line VIII—VIII shown in FIG. 7, which corresponds to the FIG. 8 plan, is located beneath the condensate drain openings 59, 60, these openings cannot be seen in FIG. 8 but the drain ducts 62 and 63, which are located underneath the openings 59, 60, can be seen and these not only extend over the length of the drain openings 59, 60 but beyond this to the bulkheads 38 and 39, from whence the intermediate pressure condensate in the two heating chambers 41 and 43 takes the same path as previously described for the low pressure condensate in the heating chambers 40 and 42 and drains at the saturation temperature into the hot well 64.

Figure 10:
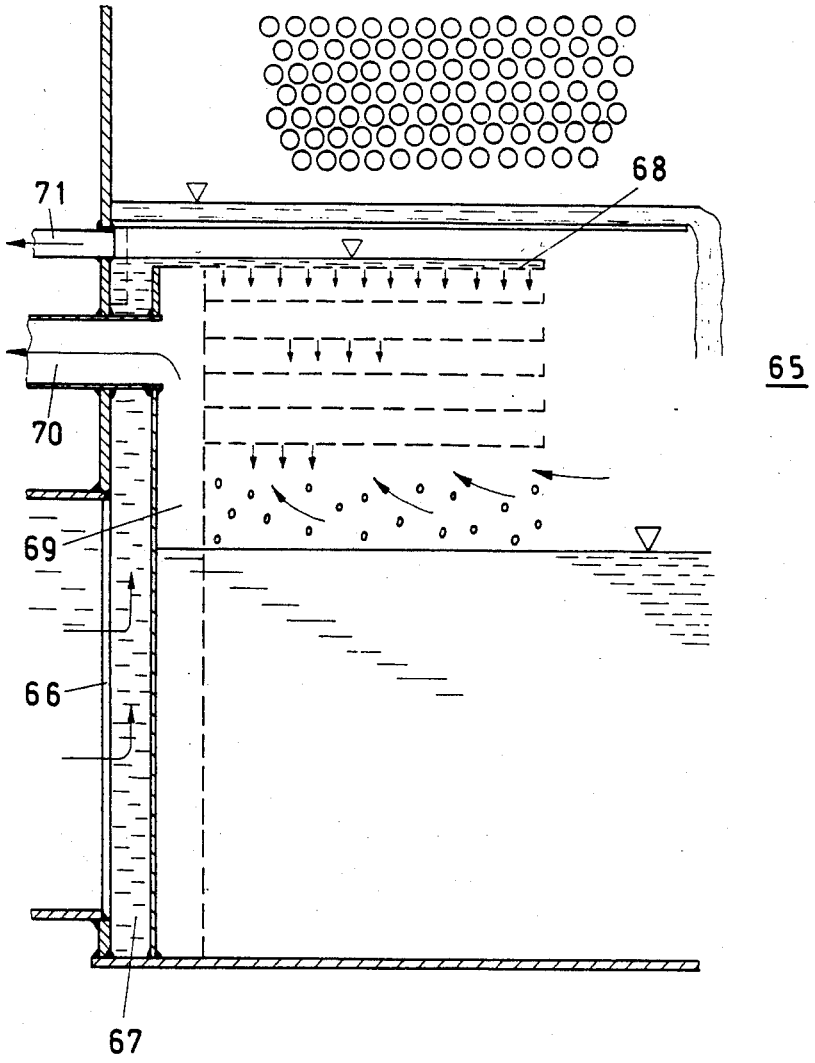
FIG. 10 shows a diagram of the heating device for a multiple pressure condenser of separated design in accordance with FIGS. 3 and 4.

FIG. 10 shows a heating device 65 for a multiple pressure condenser of separated design in accordance with FIGS. 3 and 4. Two such devices are provided, in accordance with FIG. 4, in the high pressure part of the condenser. One of the devices, 19, heats the low pressure condensate and the second, 20, heats the intermediate pressure condensate. In FIG. 10, the overcooled condensate enters through a condensate drain-pipe 66, which corresponds to one of the condensate drain-pipes 17 and 18 in FIGS. 3 and 4, into the rising duct 67, and overflows at the upper end of the latter into the highest droplet plate 68. The condensate then drips downwards through the droplet plates located underneath, as described by means of FIG. 10, and is heated by the high pressure exhaust steam. Air is extracted via an air extraction pipe 70 from the air collection duct 69 and air is extracted from the space above the highest droplet plate 68 via a second air extraction pipe 71.

What is claimed is:

1. In a multiple pressure condenser for steam turbines of the type including a first low pressure condenser unit for receiving exhaust steam that is overcooled and a second intermediate condenser unit for receiving exhaust steam that is at least at a saturation temperature, the improvement comprising:

a hot well;

an intermediate floor separating the hot well from an exhaust steam space, said floor having condensate drain openings;

a plurality of heating units, each heating unit including a multiplicity of stacked droplet plates located beneath said intermediate floor and being separated from each other, each of said droplet plates being perforated and having rims along their edges;

first drain ducts extending downwardly from said first and second condenser;

a second drain duct extending upwardly and connected to said first drain ducts, said second duct extending upwardly to the level of the highest droplet plate;

an air collection duct in communication with said hot well via a perforated wall; and at least one air extraction pipe located above said stacked droplet plates.

2. A multiple pressure condenser according to claim 1, and further including:

a third high pressure condenser unit;

said first, second and third condenser units being separated from each other; and said heating units being located in said third condenser unit.

3. A multipressure condenser unit according to claim 1, and further including:

a third high pressure condenser unit;

said first, second and third condenser units being part of an integral structure; and first and second heater units located in said first condenser unit, said first heater unit receiving condensate from said first condenser unit and said second heater unit receiving condensate from said second condenser unit.

4. A multiple pressure condenser unit according to claim 1, and further including:

a third high pressure condenser unit;

said first, second and third condenser units being part of an integral structure; and a first heater unit provided in said first condenser unit and a second heater unit provided in said second condenser unit.

* * * * *